US005143893A

United States Patent [19]

Mochizuki et al.

[11] Patent Number: 5,143,893

[45] Date of Patent: Sep. 1, 1992

[54] SUBLIMATION-TYPE THERMAL IMAGE TRANSFER RECORDING MEDIUM

[75] Inventors: Hidehiro Mochizuki, Numazu; Masaru Shimada, Shizuoka; Yutaka Ariga, Fuji, all of Japan

[73] Assignee: Ricoh Company, Ltd., Tokyo, Japan

[21] Appl. No.: 799,318

[22] Filed: Nov. 27, 1991

[30] Foreign Application Priority Data

Nov. 27, 1990 [JP] Japan ..... 2-320815
Feb. 14, 1991 [JP] Japan ..... 3-40787
Jul. 5, 1991 [JP] Japan ..... 3-165652

[51] Int. Cl.[5] ..... B41M 5/035; B41M 5/26

[52] U.S. Cl. ..... 503/227; 428/195; 428/212; 428/323; 428/336; 428/419; 428/447; 428/480; 428/500; 428/913; 428/914

[58] Field of Search ..... 428/195, 212, 323, 336, 428/419, 447, 480, 500, 913, 914; 8/471; 503/227

*Primary Examiner*—Bruce H. Hess

*Attorney, Agent, or Firm*—Oblon, Spivak, McClelland, Maier & Neustadt

[57] ABSTRACT

A sublimation-type thermal image transfer recording medium is composed of a support, a dye-supply layer and a dye-transfer layer which are successively overlaid on the support, each layer containing a sublimable dye and an organic binder agent in which the above-mentioned sublimable dye is dispersed, and a top layer provided on the dye-transfer layer, containing a non-dyeable resin or a low-dyeable resin.

8 Claims, 3 Drawing Sheets

SUBLIMATION-TYPE THERMAL IMAGE TRANSFER RECORDING MEDIUM

BACKGROUND OF THE INVENTION

1. Field of the Invention

The present invention relates to a sublimation-type thermal image transfer recording medium, and more particularly to a sublimation-type thermal image transfer recording medium for the multiple printing method, which comprises a dye-supply layer, a dye-transfer layer and a top layer which are successively overlaid on a support.

2. Discussion of Background

Recently the demand for full color printers is increasing year by year. Typical recording methods for full color printers now available include the electrophotographic method, the ink-jet method, and the thermosensitive image transfer method. Of these methods, the thermosensitive image transfer method is most widely employed because of its advantages over the other methods in that the maintenance is easy and the operation is noiseless.

In the thermosensitive image transfer recording method, a thermal image transfer recording medium, that is, a color ink sheet, and an image-receiving sheet are employed. The above-mentioned thermal image transfer recording medium comprises a support and an ink layer formed thereon in which a coloring agent is dispersed in a thermofusible material, or a sublimable dye is dispersed in a binder resin.

To carry out the thermosensitive image transfer recording, the image-receiving sheet is superimposed on the ink layer of the thermal image transfer recording medium and a color ink is transferred imagewise from the thermal image transfer recording medium to the image-receiving sheet by the thermal fusion of the coloring agent or the sublimation of the sublimable dye under the application of thermal energy to the recording medium by laser beams or through a thermal head which is energized by the electric signals corresponding to the images to be recorded.

The thermosensitive image transfer recording methods can be roughly classified into two types, a thermal fusing image transfer type and a sublimation image transfer type. The sublimation image transfer type is advantageous over the thermal fusing type in that a halftone can be obtained without difficulty and the image gradation ca be controlled as desired. These advantages can be obtained because a sublimable dye is in principle sublimated in the form of individually separated molecules in such an amount as to correspond to the amount of thermal energy applied thereto, for instance, from a thermal head, and transferred to the image-receiving sheet. Therefore, the sublimation image transfer type is considered to be most suitable for color printers.

The sublimation image transfer recording method, however, has a shortcoming in that its running cost is high, because in this image transfer method, a yellow ink sheet, a magenta ink sheet, a cyan ink sheet and, if necessary, a black ink sheet, are employed in order to obtain a full-color image, with selective application of thermal energy to each ink sheet, and discarded after the recording even though large unused portions remain on each ink sheet.

To eliminate this shortcoming, a multiple printing recording method has been proposed, by which an ink sheet can used repeatedly.

The multiple printing recording method can be accomplished by either an equal-speed mode method or an n-times-speed mode method. In the former method, an ink sheet and an image-receiving sheet are moved at the same speed when images are recorded. In the latter method, the running speed of the image-receiving sheet is n ($n > 1$) times the running speed of the ink sheet when images are printed, so that the ink sheet is shifted relative to the image-receiving sheet in such a manner that a preceding portion of the ink sheet and the following portion thereof partly overlap with respect to the ink transfer therefrom in the course of the thermal printing. Therefore as a matter of course, the larger the value of "n", the larger the cost reduction in printing.

In such an n-times-speed mode method, the ink is supplied at least from a newly used portion of the ink sheet in each printing, so that the amount of a residual ink in the ink sheet can be maintained constant in comparison with the equal-speed mode method in which a used portion of the ink sheet is merely used repeatedly. Therefore, the n-times-speed mode method is advantageous over the equal-speed mode method with respect to the minimization of the amount of the residual ink in the ink sheet from the viewpoint of the recording history of the ink sheet as reported in the Journal of the Institute of Electronics and Communication Engineers, Vol. J70-C, No. 11, pages 1537–1544 (1987).

The multiple printing recording methods such as the n-times-speed mode method and the equal-speed mode method, however, have the drawback that the sublimable dye which has been transferred to the image-receiving sheet is transferred back to the ink layer of the thermal image transfer recording medium. As a result, the color of the image subsequently formed becomes turbid and a ghost image is formed on the image-receiving sheet, so that clear images cannot be obtained.

The previously mentioned "ghost image" is formed in such a fashion that a reversely transferred image from the image-receiving sheet to the thermal image transfer recording medium is transferred again to a different portion of the image-receiving sheet in the equal-speed mode method.

In the n-times-speed mode method, since the thermal image transfer recording sheet is continuously moved, an edge portion of the obtained image tends to become tail-shaped.

The above-mentioned drawback in the sublimation image transfer recording method stems from the thermal diffusion of the sublimable dye from the ink layer of the thermal image transfer recording medium to the image-receiving sheet, which are closely brought into pressure contact with each other by a thermal head and a platen roller.

When a secondary or tertiary color is formed on the image-receiving sheet by superimposing two or three dyes in the full-color printing process, the dye which has been already transferred to the image-receiving sheet is transferred back to the ink layer of the thermal image transfer recording medium. This phenomenon is hereinafter referred to as "reverse transfer." In the one-time printing method, since the thermal image transfer recording sheet in which the reverse transfer has occurred is discarded, the above-mentioned problem does not affect the image formation. In the multiple printing recording method, however, the image reversely transferred to the ink layer of the thermal image transfer recording sheet is transferred again to the other position of the image-receiving sheet, and causes the color turbidity and forms a ghost image, thereby adversely affecting the subsequent recording. This adverse effect can be visually reduced to some degree by changing the order of colors to be transferred. However, this method cannot satisfactorily solve the problem.

To solve the reverse transfer problem, there is disclosed in Japanese Laid-Open Patent Application 61-293891 a method of forming each color image on a different transparent image-receiving sheet and overlapping the image-receiving sheets to obtain a full-color image. This method, however, has the shortcomings that such special image-receiving sheets are necessary, the thus prepared image-receiving medium is thicker than conventional image receiving media since three image-receiving sheets are used, and costly. Furthermore, this method has the risk that the obtained full-color image is made blurred even by a slight deviation of the registration of the three image-receiving sheets.

SUMMARY OF THE INVENTION

Accordingly, an object of the present invention is to provide a sublimation-type thermal image transfer recording medium with high sensitivity, which is capable of yielding clear images by the multiple printing recording method without the formation of a ghost image and trailing of an edge portion of the image which result from the reverse transfer of the sublimable dye contained therein.

The above-mentioned object of the present invention can be achieved by a sublimation-type thermal image transfer recording medium which comprises a support, a dye-supply layer and a dye-transfer layer which are successively overlaid on the support, each comprising a sublimable dye dispersed in an organic binder agent, and a top layer formed on the dye-transfer layer, comprising a non-dyeable resin or a low-dyeable resin.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
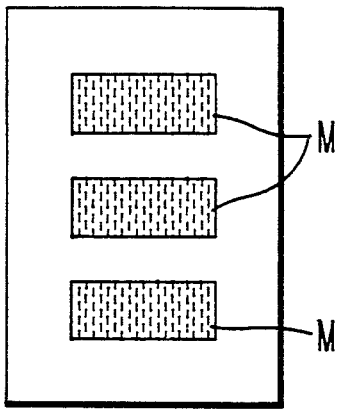
FIG. 1 illustrate an image-receiving sheet carrying block images of a magenta color thereon.

The sublimation-type thermal image transfer recording medium of the present invention is characterized by the following points:

(1) The thermal image transfer recording medium according to the present invention comprises a dye-supply layer and a dye-transfer layer, with the concentration of the sublimable dye in the dye-supply layer being higher than that in the dye-supply layer In this thermal image transfer recording medium, therefore, the multi-utilization capability of the recording medium is improved because the dye-transfer layer can be replenished with the sublimable dye in the dye-supply layer as the consumption of the sublimable dye in the dye-transfer layer.

(2) The dye-supply layer of the thermal image transfer recording medium comprises at least a sublimable dye in the form of granules, which is dispersed in an organic binder agent.

As a result, the sublimable dye in the dye-supply layer can be effectively prevented from escaping to the dye-transfer layer when an organic solvent in which the sublimable dye is dissolved is coated on the dye-supply layer for the formation of the dye-transfer layer, so that the concentration gradient of the sublimable dye can be maintained in both layers.

In addition, it is possible to maintain the concentration of the sublimable dye dispersed in a molecular order in the binder agent of the dye-supply layer, so that the multi-utilization capability of the recording medium is improved. More specifically, the concentration of the dye is determined by the amount of the sublimable dye in the form of molecules in each layer. In this thermal image transfer recording medium, as the sublimable dye contained in the dye-supply layer in the form of molecules is sent to the dye-transfer layer, the sublimable-dye in the form of granules is turned into the dye in the form of molecules in the dye-supply layer, thereby maintaining the dye concentration in the dye-supply layer.

(3) The sublimable dye soluble in an organic solvent is contained in the dye-transfer layer.

Accordingly, such a sublimable dye can be contained in the dye-transfer layer in large quantities. Therefore, a sufficient amount of the sublimable dye can be dispersed in the form of molecules in the dye-transfer layer, which prevents the decrease in dye concentration in the dye-transfer layer and decrease in sensitivity.

(4) A top layer formed on the dye-transfer layer comprises a non-dyeable resin or a low-dyeable resin.

Consequently, the reverse transfer of the dye from the surface of the image-receiving sheet to the recording medium scarcely takes place in the course of overlapping of colors. As a result, the deterioration of the image quality due to the color turbidity, formation of ghost images and a trailing edge of a block image can be avoided.

(5) It is preferable that the top layer comprise a sublimable dye, which is dispersed in the non-dyeable or low-dyeable resin.

The amount of the dye to be transferred to the image-receiving sheet depends on the diffusion coefficient of the dye and the dye concentration gradient. In the recording medium of the present invention, the dye concentration gradient of the top layer of the recording medium can be thus increased, so that the deterioration in sensitivity resulting from the formation of the top layer can be improved.

In the thermal image transfer recording medium, it is important that the sublimable dye in the dye-supply layer be readily diffused to the dye-transfer layer and the dye-transfer layer be constantly replenished with the sublimable dye.

To readily diffuse the sublimable dye from the dye-supply layer to the dye-transfer layer, as previously mentioned, the following methods have been proposed:

(I) the concentration of the sublimable dye in the dye-supply layer is designed to be higher than that in the dye-transfer layer, and/or (II) the diffusion coefficient of the sublimable dye in the dye-supply layer is designed to be higher than that in the dye-transfer layer.

Furthermore, to satisfy the above-mentioned relationship (II) between the diffusion coefficient of the sublimable dye in the dye-supply layer and that in the dye-transfer layer, several proposals are introduced, for example, in Fiber Association Journal, Toyoko Sakai et al., Vo. 30, No. 12 (1974); "Theoretical Chemistry in Dyeing" Norihiko Kuroki, p.503 -; and Proc. of 1st Non-impact Printing Technologies Symposium, vol. 3-5.

By referring to the above proposals, the relationship (II) can be satisfied by the following methods:

(1) The diffusion coefficient of a sublimable dye is influenced by the energy inhibiting the diffusion of a sublimable dye, for example, by the hydrogen bonding between the dye and the organic binder agent in which the dye is dispersed. Therefore, an organic polymeric material having many proton-donner groups or proton-acceptor groups, which can easily undergo the hydrogen bonding with the sublimable dye, may be used as the binder agent in the dye-transfer layer.

(2) The diffusion coefficient of a sublimable dye is dependent o the glass transition temperature or softening point of an organic binder agent in which the dye is dispersed. In the sublimation image transfer recording process, the diffusion coefficient of the dye is increased when the glass transition temperature or softening point of the binder agent in which the dye is dispersed is lower than the heated temperature of a dye-containing layer. Therefore, an organic binder agent having a glass transition temperature or softening point lower than that of the organic binder agent contained in the dye-transfer layer may be used in the dye-supply layer.

(3) A plasticizer which is compatible with at least one organic binder agent in the dye-supply layer and not compatible with all the organic binder agents contained in the dye-transfer layer may be contained in the dye-supply layer.

(4) The above-mentioned methods (1) to (3) may be appropriately used in combination.

As a matter of course, the methods for establishing the above-mentioned relationship (II) between the diffusion coefficient of the dye in the dye-supply layer and that in the dye-transfer layer are not limited to the above.

In the present invention, it is preferable that the concentration of the sublimable dye in the dye-supply layer be higher than that in the dye-transfer layer, and/or the diffusion coefficient of the sublimable dye in the dye-supply layer be higher than that in the dye-transfer layer. To confirm these relationships, a dye-supply layer and a dye-transfer layer are separately prepared by coating the formulations for each layer in the same deposition amount on the support sheets. Each layer is superimposed on an image-receiving sheet and heated to a predetermined sublimation temperature. It can be confirmed that the above relationships are satisfied when the amount of the sublimable dye to be transferred from the dye-supply layer to the image-receiving sheet is more than the amount of the sublimable dye to be transferred from the dye-transfer layer to the image-receiving sheet.

In the present invention, it is preferable that the thickness of the dye-transfer layer be 0.05 to 5 μm, more preferably 0.1 to 2 μm. The thickness of the dye-supply layer is preferably from 0.1 to 20 μm, more preferably from 0.5 to 10 μm.

In the dye-transfer layer and the dye-supply layer for use in the present invention, conventional sublimable dyes and binder agents can be used.

Any disperse and oil-soluble dyes which can sublime or vaporize at a temperature of 60° C. or more and are ordinarily used in the field of thermal image transfer recording can be used in the dye-transfer layer and the dye-supply layer of the thermal image transfer recording medium of the present invention. Specific examples of such sublimable dyes include C.I. Disperse Yellows 1, 3, 8, 9, 16, 41, 54, 60, 77 and 116; C.I. Disperse Reds 1, 4, 6, 11, 15, 17, 55, 59, 60, 73 and 83; C.I. Disperse Blues 3, 14, 19, 26, 56, 60, 64, 72, 99 and 108; C.I. Solvent Yellows 77 and 116; C.I. Solvent Reds 23, 25 and 27; and C.I. Solvent Blues 36, 83 and 105. These dyes can be used alone or in combination.

A thermoplastic resin and a thermosetting resin can be used as the binder agent in the dye-transfer layer and the dye-supply layer. Examples of such a binder agent include vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-contained resin, butyral resin, melamine resin, natural rubber, synthetic rubber and cellulose resin. These resins, which have a relatively high glass transition temperature or softening point, can be used alone or in combination. In addition, a variety of copolymers prepared from the monomers used in the above resins can be employed.

Furthermore, to make the glass transition temperature or softening point of the dye-transfer layer differ from that of the dye-supply layer, resins and natural or synthetic rubbers having a glass transition temperature of 0° C. or less or a softening point of 60° C. or less are preferably used as the binder agents.

Specific examples of such resins and rubbers include syndiotactic 1,2-polybutadiene, such as commercially available products, "JSR RB810", "JSR RB820" and "JSR RB830" (Trademarks), made by Japan Synthetic Rubber Co., Ltd.; olefin copolymers and terpolymers having an acidic group or non-acidic group, such as a commercially available product, "Dexon XEA-7" (Trademark), made by Dexon Chemical Co., Ltd.; ethylene—vinyl acetate copolymer, such as commercially available products, "400&400A", "405" and "430" (Trademarks), made by Allied Fibers & Plastics Co., Ltd., and "P-3307 (EV150)" and "P-2807 (EV250)" (Trademarks), made by Du Pont—Mitsui Polychemicals Co., Ltd.; low molecular weight polyolefin polyols and derivatives thereof, such as commercially available products "Polytail H" and "Polytail HE" (Trademarks), made by Mitsubishi Chemical Industries, Ltd.; brominated epoxy resins, such as commercially available products, "YDB-340", "YDB-400", "YDB-500" and "YDB-600" (Trademarks), made by Toto Chemical Co., Ltd.; novolak-type epoxy resins, such as commercially available products, "YDCN-701", "YDCN-702" and "YDCN-703" (Trademarks), made by Tobu Chemical Industry Corporation; thermoplastic acrylic resin solutions, such as commercially available products "Dianal LR1075", "Dianal LR1080", "Dianal LR1081", "Dianal LR1082", "Dianal LR1063" and "Dianal LR1079" (Trademarks), made by Mitsubishi Rayon Engineering Co., Ltd.; thermoplastic acrylic resin emulsions, such as commercially available products, "LX-400" and "LX-450" (Trademarks), made by Mitsubishi Rayon Engineering Co., Ltd.; polyethylene oxides, such as commercially available products, "Alkox E-30", "Alkox E-45", "Alkox R-150", "Alkox R-400" and "Alkox R-1000" (Trademarks), made by Meisei Chemical Works, Ltd.; and caprolactam polyols, such as commercially available products, "Placcel H-1", "Placcel H-4" and "Placcel H-7" (Trademarks), made by Daicel Chemical Industries, Ltd. Of these, polyethylene oxides and polycaprolactam polyols are preferable in practice. It is preferable that the thermoplastic resins and thermosetting resins as previously mentioned be used in combination with one or more such resins or rubbers.

The concentration of the sublimable dye in the dye-transfer layer is generally 5 to 80%, and preferably 10 to 60%.

It is preferable that the concentration of the sublimable dye in the dye-supply layer be 5 to 80%. In the case where a dye concentration gradient is established in the dye-transfer layer and the dye-supply layer, it is preferable that the dye concentration in the dye-supply layer be 1.1 to 5 times, more preferably 1.5 to 3 times the dye concentration in the dye-transfer layer.

To replenish the dye-transfer layer with the sublimable dye constantly and achieve the satisfactory printing performance over an extended period of time, it is preferable that the dye-supply layer contain at least a sublimable dye in the state of undissolved particles, that is in the form of glanules. When a coating liquid for the dye-supply layer comprising an organic binder agent, a sublimable dye and a solvent is prepared, it is preferable that the sublimable dye separate out in the form of a granule in the coating liquid for the dye-supply layer.

The existing condition of the granular sublimable dye in the dye-supply layer varies depending on the kind of solvent, even though the same binder agent and the same sublimable dye are employed. The presence of the granular sublimable dye separating out in the dye-supply layer can be easily recognized by an electron microscope after formation of the dye-supply layer. The particle diameter of the granular dye, varying depending upon the thickness of the dye-supply layer, is generally 0.01 to 20 μm, and preferably 1.0 to 5 μm.

In the dye-transfer layer, it is desirable that the sublimable dye in the form of independent molecules be dispersed in the binder agent so as to promptly transfer to the image-receiving sheet in practice. Thus, the unevenness in density of transferred images can be prevented, and the dye concentration gradient between the dye-supply layer and the dye-transfer layer can be stabilized.

For the support of the sublimation-type thermal image transfer recording medium according to the present invention, a sheet of condenser paper, or a film of polyester, polystyrene, polysulfone, polyimide and polyamide can be used.

When necessary, an adhesive layer may be interposed between the support and the dye-supply layer, and a heat-resistant protective layer may be formed on the reverse surface of the support, opposite to the dye-supply layer.

As noted above, the two-layered ink layer consisting of a dye-supply layer and a dye-transfer layer is one embodiment of the sublimation-type thermal image transfer recording medium according to the present invention. A multi-layered type ink layer may be formed, as far as the transferred amount of dye from each layer can be appropriately made different and the function can be separated as desired in the present invention.

The thermal image transfer recording medium according to the present invention can be applied to the thermal image transfer by using a thermal head, as previously mentioned. In addition, thermal image transfer using the thermal image transfer recording medium of the present invention can be achieved by bringing a heat plate into contact with the recording medium, applying laser beams thereto or causing an electric current to flow through the support and/or the ink layer of the recording medium so as to generate Joule's heat therein, that is, by the so-called electrothermic non-impact printing. The electrothermic non-impact printing method is described in many references, such as U.S. Pat. No. 4,103,066 and Japanese Laid-Open Patent Applications 57-14060, 57-11080 and 59-9096.

When the electrothermic non-impact printing method is employed, the following materials are used for the support of the sublimation-type thermal image transfer recording medium according to the present invention: materials which are modified to have an intermediate electric resistivity between the electric resistivities of an electroconductive material and an insulating material, for example, by dispersing finely-divided electroconductive particles, such as finely-divided metal particles of aluminum, copper, iron, tin, zinc, nickel, molybudenum and silver and/or carbon black, in a resin having relatively high heat resistance, such as polyester, polycarbonate, triacetyl cellulose, nylon, polyimide and aromatic polyimides, or by using a support of the above-mentioned resins, with the above-mentioned electroconductive metals deposited thereon by vacuum deposition or sputtering.

It is preferable that the thickness of the above support be in the range of approximately 2 to 15 μm when the thermal conductivity thereof for the generated Joule's heat is taken into consideration.

When laser beams are employed for image transfer, it is preferable that the support absorb laser beams and generate heat. For this purpose, for example, a material which absorbs heat and converts the light into heat, such as carbon black, may be contained in a conventional thermal image transfer film to prepare a support. Alternatively, a light-absorbing and heat-generating layer may be laminated on the obverse and/or reverse surface of the support.

The top layer of the thermal image transfer recording medium according to the present invention will now be described in detail.

The preferable non-dyeable resin or low-dyeable resin for use in the top layer may be determined in accordance with the following evaluation:

A variety of resins (test materials) are separately dissolved in a volatile solvent in an amount of 5 to 20 wt.%, so that resin solutions are prepared. A mixture of the commercially available modified silicone oils, "SF8417" and "SF8411" (Trademarks), made by Toray Silicone Co., Ltd., at the mixing ratio by weight of 1:1, is added to each of the above-prepared resin solutions in an amount of 30 wt.% of the solid content of the resin solution, whereby coating liquids are obtained. Each coating liquid is coated on a sheet of commercially available synthetic paper "Yupo FPG#95" (Trademark), made by Oji-Yuka Synthetic Paper Co., Ltd., and dried at 70° C. for one minute and at room temperature for one day or more, so that a resin layer with a thickness of 10 μm on a dry basis is formed on a base sheet. Thus, a variety of image-receiving sheets are prepared.

A commercially available thermal image transfer ink ribbon, "Sheet Set CK2LB" for Mitsubishi color video copy processor, which is cyan, is overlaid on each of the above-prepared image-receiving sheets. Then, thermal image transfer is conducted with the application of the thermal energy of 2.00 mj/dot to the thermal image transfer ink ribbon by using a commercially available thermal head "KMT-85-6MPD4" (Trademark), made by Kyocera Corp., with a resolution of 6 dots/mm and an average resistivity of 542 Ω. The density of images thus transferred to the image-receiving sheet is measured by a Mcbeth reflection-type densitometer RD-918. As a result, in the case where the density of images on the image-receiving sheet is 1.2 or less, preferably 1.0 or less, the resin used in the resin layer of the image-receiving sheet is considered to be applicable to the top thin layer of the thermal image transfer recording medium according to the present invention as the non-dyeable or low-dyeable resin.

Namely, when the density of the images transferred to a resin is as low as 1.2 or less, this resin can be used as the non-dyeable resin or low-dyeable resin for use in the top thin layer in the present invention.

The above evaluation proves that an aromatic polyester resin, a styrene—butadiene resin, a polyvinyl acetate resin and a polyamide resin are suitable for the top thin layer of the recording medium of the present invention.

Furthermore, preferable examples of the resin for use in the top layer include a methacrylate resin and a methacrylate-based copolymer, a polyimide resin, an acetate resin, a silicone resin, a styrene-acrylonitrile resin, a polysulfone resin, styrene—maleic acid resin and a styrene—maleic acid—ester copolymer resin. Examples of the ester group of the above-mentioned styrene—maleic acid—ester copolymer resin are methyl group, ethyl group, n-propyl group, iso-propyl group, n-butyl group, sec-butyl group, ter-butyl group, n-amyl group, n-hexyl group, cyclohexyl group, allyl group, benzyl group and phenyl group.

It is preferable that the thickness of the to layer of the thermal image transfer recording medium according to the present invention be 0.1 to 2 μm, more preferably 1.0 μm or less. When the thickness of the top thin layer is within the above range, the overall surface of the dye-transfer layer can be sufficiently covered with the top layer even though the surface of the dye-transfer layer is microscopically rough. Therefore, the formation of ghost images and tailing of edge portions of an image caused by the reverse transfer can be effectively prevented. In addition, the top layer does not hinder the diffusion of the sublimable dye, so that the sensitivity is not degraded.

It is preferable that the top layer comprise a sublimable dye. When the sublimable dye is contained in the top layer, it is preferable that the sublimable dye in the form of molecules be dispersed in the above-mentioned non-dyeable resin or low-dyeable resin. If the sublimable dye in the form of granules is contained in the top layer, pinholes easily occur in the top layer and the surface smoothness of the top layer is lowered as compared with the case of the dye in the form of molecules.

The dye concentration in the top layer is 60% or less, preferably 10 to 60%, and more preferably 20 to 50%. When the dye concentration in the top layer is within the above range, the sensitivity can be improved and the effect of preventing the reverse transfer can be attained.

When the sublimation-type image transfer recording medium according to the present invention is adapted to the n-times-speed mode method, a lubricant may be contained in the top layer of the recording medium for the purpose of improving the transport performance of the recording medium.

Specific examples of the lubricant for use in the top layer include petroleum lubricating oils such as liquid paraffin; synthetic lubricating oils such as halogenated hydrogen, diester oil, silicone oil and fluorine-contained silicone oil; a variety of modified silicone oils such as epoxy-modified silicone oil, amino-modified silicone oil, alkyl-modified silicone oil and polyether-modified silicone oil; silicone-type lubricants, for example, a copolymer of an organic compound such as polyoxyalkyleneglycol and silicone; fluorine-contained surface active agents such as fluoroalkyl compounds; fluorine-contained lubricants such as ethylene chloride trifluoride oligomers; waxes such as paraffin wax and polyethylene wax; higher fatty acids; higher aliphatic alcohols; amides of higher fatty acids esters of higher fatty acids; salts of higher fatty acids; and a variety of finely-divided particles having lubricating properties and release properties.

It is preferable that the amount of the lubricant be 5 to 30 wt.% of the total weight of the top layer. When the lubricant is contained in the top layer in such an amount, the lubricating properties of the recording medium are improved, so that the top layer of the recording medium can be prevented from sticking to the image-receiving sheet during the thermal transfer operation. At the same time, the sensitivity and the durability of the recording medium are not degraded.

Other features of this invention will become apparent in the course of the following description of exemplary embodiments, which are given for illustration of the invention and are not limiting thereof.

EXAMPLE I

A silicone resin was coated on one side of a film of aromatic polyamide with a thickness of 6 μm, serving as a support, so that a heat-resistant protective layer with a thickness of 1 μm was formed on one side of the support.

Formation of Adhesive Layer

The following components were mixed to prepare a coating liquid for an adhesive layer:

| | Parts by Weight |
|---|---|
| Polyvinyl butyral resin | 10 |

-continued

| | Parts by Weight |
|---|---|
| "BX-1" (Trademark) made by Sekisui Chemical Co., Ltd. | |
| Diisocyanate "Coronate L" (Trademark) made by Nippon Polyurethane Industry Co., Ltd. | 5 |
| Toluene | 95 |
| Methyl ethyl ketone | 95 |

The above-obtained coating liquid was coated on the other side of the support, opposite to the heat-resistant protective layer, so that an adhesive layer with a thickness of 1 μm was formed on the support.

Preparation of Coating Liquid for Dye-supply Layer

The following components were dispersed in a ball mill to prepare a coating liquid for a dye-supply layer:

| | Parts by Weight |
|---|---|
| Polyvinyl butyral resin "BX-1" (Trademark) made by Sekisui Chemical Co., Ltd. | 7 |
| Polyethylene oxide "Alkox R-400" (Trademark) made by Meisei Chemical Works, Ltd. | 3 |
| Sublimable dye "Kayaset Blue 714" (Trademark) made by Nippon Kayaku Co., Ltd. | 30 |
| Diisocyanate "Coronate L" (Trademark) made by Nippon Polyurethane Industry Co., Ltd. | 3 |
| Toluene | 95 |
| Methyl ethyl ketone | 95 |

Preparation of Coating Liquid for Dye-transfer Layer

The following components were dispersed in a ball mill to prepare a coating liquid for a dye-transfer layer:

| | Parts by Weight |
|---|---|
| Polyvinyl butyral resin "BX-1" (Trademark) made by Sekisui Chemical Co., Ltd. | 10 |
| Sublimable dye "Kayaset Blue 714" (Trademark) made by Nippon Kayaku Co., Ltd. | 10 |
| Diisocyanate "Coronate L" Trademark) made by Nippon Polyurethane Industry Co., Ltd. | 3 |
| Toluene | 95 |
| Methyl ethyl ketone | 95 |

The above-prepared coating liquid for a dye-supply layer was coated on the adhesive layer by a wire bar in a thickness of 4.5 μm, and the coating liquid for a dye-transfer layer was further coated thereon in a thickness of 1.0 μm, and then dried at 60° C. for 24 hours for curing the coating liquids. Thus, a recording medium A was obtained.

EXAMPLE I-1

Preparation of Resin Component (styrene-maleic acid-isopropyl ester copolymer) in Formulation for Top Layer Coating Liquid A mixture of 5 g of finely-divided particles of styrene—maleic acid copolymer and 250 ml of isopropanol was stirred for 2 hours at 70° C., so that a colorless transparent styrene—maleic acid—isopropyl ester copolymer was obtained. The thus obtained styrene—maleic acid—isopropyl ester copolymer was added to large quantities of n-hexane, thereby styrene—maleic acid—isopropyl ester copolymer was obtained in a powdered form.

Preparation of Coating Liquid for Top Layer

The following components were mixed to prepare a coating liquid for a top thin layer:

| | Parts by Weight |
|---|---|
| Styrene-maleic acid-isopropyl ester copolymer (obtained by the above-mentioned method) | 10 |
| Carboxyl-modified silicone oil "SF8418" (Trademark) made by Toray Silicone Co., Ltd. | 1.5 |
| Epoxy-modified silicone oil "SF8411" (Trademark) made by Toray Silicone Co., Ltd. | 1.5 |
| Tetrahydrofuran | 40 |

The above-prepared coating liquid was coated on the dye-transfer layer of the recording medium A obtained in Example I by a wire bar, so that a top layer with a thickness of 0.7 μm was formed on the dye-transfer layer.

Thus, a sublimation-type thermal image transfer recording medium according to the present invention was obtained.

EXAMPLE I-2

The procedure for preparation of the sublimation-type thermal image transfer recording medium in Example I-1 wa repeated except that the formulation for the top layer coating liquid in Example I-1 was changed to the following formulation for a top layer coating liquid:

| | Parts by Weight |
|---|---|
| Styrene-maleic acid, "AP-30" (Trademark), made by BASF Japan Ltd. | 20 |
| Carboxyl-modified silicone oil "SF8418" (Trademark) made by Toray Silicone Co., Ltd. | 1.5 |
| Epoxy-modified silicone oil "SF8411" (Trademark) made by Toray Silicone Co., Ltd. | 1.5 |
| Tetrahydrofuran | 80 |

Thus, a sublimation-type thermal image transfer recording medium according to the present invention was obtained.

EXAMPLE I-3

The procedure for preparation of the sublimation-type thermal image transfer recording medium in Example I-1 was repeated except that the formulation for the top layer coating liquid in Example I-1 was changed to the following formulation for a top layer coating liquid:

| | Parts by Weight |
|---|---|
| Styrene acrylonitrile "Litac A330-PC" (Trademark), made by Mitsui Toatsu Chemicals, Inc. | 15 |
| Carboxyl-modified silicone oil "SF8418" (Trademark) made by | 1.5 |

-continued

| | Parts by Weight |
|---|---|
| Toray Silicone Co., Ltd. | |
| Epoxy-modified silicone oil "SF8411" (Trademark) made by Toray Silicone Co., Ltd. | 1.5 |
| Tetrahydrofuran | 42.5 |
| Toluene | 42.5 |

Thus, a sublimation-type thermal image transfer recording medium according to the present invention was obtained.

EXAMPLE I-4

The procedure for preparation of the sublimation-type thermal image transfer recording medium in Example I-1 was repeated except that the formulation for the top layer coating liquid in Example I-1 was changed to the following formulation for a top layer coating liquid:

| | Parts by Weight |
|---|---|
| Polymethyl methacrylate "Dianal BR-85" Trademark) made by Mitsubishi Rayon Engineering Co., Ltd. | 10 |
| Carboxyl-modified silicone oil "SF8418" (Trademark) made by Toray Silicone Co., Ltd. | 1.5 |
| Epoxy-modified silicone oil "SF8411" (Trademark) made by Toray Silicone Co., Ltd. | 1.5 |
| Toluene | 42.5 |
| Methyl ethyl ketone | 42.5 |

Thus, a sublimation-type thermal image transfer recording medium according to the present invention was obtained.

EXAMPLE I-5

The procedure for preparation of the sublimation-type thermal image transfer recording medium in Example I-1 was repeated except that the formulation for the top layer coating liquid in Example I-1 was changed to the following formulation for a top layer coating liquid:

| | Parts by Weight |
|---|---|
| Polysulfone "P-1700NT11" (Trademark) made by Nissan Chemical Industries, Ltd. | 15 |
| Carboxyl-modified silicone oil "SF8418" (Trademark) made by Toray Silicone Co., Ltd. | 1.5 |
| Epoxy-modified silicone oil "SF8411" (Trademark) made by Toray Silicone Co., Ltd. | 1.5 |
| Tetrahydrofuran | 85 |

Thus, a sublimation-type thermal image transfer recording medium according to the present invention was obtained.

EXAMPLE I-6

The procedure for preparation of the sublimation-type thermal image transfer recording medium in Example I-1 was repeated except that the formulation for the top layer coating liquid in Example I-1 was changed to the following formulation for a top layer coating liquid:

| | Parts by Weight |
|---|---|
| Silicone resin "SR-5410" (Trademark) made by Toray Silicone Co., Ltd. | 75 |
| Carboxyl-modified silicone oil "SF8418" (Trademark) made by Toray Silicone Co., Ltd. | 1.5 |
| Epoxy-modified silicone oil "SF8411" (Trademark) made by Toray Silicone Co., Ltd. | 1.5 |
| Toluene | 12.5 |
| Benzene | 12.5 |

Thus, a sublimation-type thermal image transfer recording medium according to the present invention was obtained.

COMPARATIVE EXAMPLE I-1

The procedure for preparation of the recording medium A in Example I was repeated except that the formulation for the dye-transfer layer coating liquid in Example I was changed to the following formulation for a dye-transfer layer coating liquid:

| | Parts by Weight |
|---|---|
| Polyvinyl butyral resin "BX-1" (Trademark) made by Sekisui Chemical Co., Ltd. | 10 |
| Sublimable dye "Kayaset Blue 714" (Trademark) made by Nippon Kayaku Co., Ltd. | 10 |
| Diisocyanate "Coronate L" (Trademark) made by Nippon Polyurethane Industry Co., Ltd. | 3 |
| Carboxyl-modified silicone oil "SF8418" (Trademark) made by Toray Silicone Co., Ltd. | 1.5 |
| Epoxy-modified silicone oil "SF8411" (Trademark) made by Toray Silicone Co., Ltd. | 1.5 |
| Toluene | 95 |
| Methyl ethyl ketone | 95 |

Thus, a comparative sublimation-type thermal image transfer recording medium was obtained.

COMPARATIVE EXAMPLE I-2

The procedure for preparation of the sublimation-type thermal image transfer recording medium in Example I-1 was repeated except that the formulation for the top layer coating liquid in Example I-1 was changed to the following formulation for a top layer coating liquid:

| | Parts by Weight |
|---|---|
| Polycarbonate resin "Panlite C-1400" (Trademark) made by Teijin Limited. | 5 |
| Carboxyl-modified silicone oil "SF8418" (Trademark) made by Toray Silicone Co., Ltd. | 1.5 |
| Epoxy-modified silicone oil "SF8411" (Trademark) made by Toray Silicone Co., Ltd. | 1.5 |
| Tetrahydrofuran | 47.5 |
| Dioxane | 47.5 |

Thus, a comparative sublimation-type thermal image transfer recording medium was obtained.

COMPARATIVE EXAMPLE I-3

The procedure for preparation of the sublimation-type thermal image transfer recording medium in Example I-1 was repeated except that the formulation for the top layer coating liquid in Example I-1 was changed to the following formulation for a top layer coating liquid:

| | Parts by Weight |
|---|---|
| Ethylene-vinyl chloride copolymer "Ryuron E-800" (Trademark) made by Tosoh Corporation | 5 |
| Carboxyl-modified silicone oil "SF8418" (Trademark) made by Toray Silicone Co., Ltd. | 1.5 |
| Epoxy-modified silicone oil "SF8411" (Trademark made by Toray Silicone Co., Ltd. | 1.5 |
| Toluene | 47.5 |
| Methyl ethyl ketone | 47.5 |

Thus, a comparative sublimation-type thermal image transfer recording medium was obtained.

COMPARATIVE EXAMPLE I-4

The procedure for preparation of the sublimation-type thermal image transfer recording medium in Example I-1 was repeated except that the formulation for the top layer coating liquid in Example I-1 was changed to the following formulation for a top layer coating liquid:

| | Parts by Weight |
|---|---|
| Vinyl chloride-vinyl acetate copolymer "VAGH" (Trademark) made by Union Carbide Japan K.K. | 15 |
| Carboxyl-modified silicone oil "SF8418" (Trademark) made by Toray Silicone Co., Ltd. | 1.5 |
| Epoxy-modified silicone oil "SF8411" (Trademark) made by Toray Silicone Co., Ltd. | 1.5 |
| Toluene | 42.5 |
| Methyl ethyl ketone | 42.5 |

Thus, a comparative sublimation-type thermal image transfer recording medium was obtained.

EXAMPLE II-1

Preparation of Coating Liquid for Top Layer

The following components were mixed to prepare a coating liquid for a top layer:

| | Parts by Weight |
|---|---|
| Styrene-maleic acid-isopropyl ester copolymer obtained in Example I-1) | 10 |
| Sublimable dye "Kayaset Blue 714" (Trademark) made by Nippon Kayaku Co., Ltd. | 15 |
| Diisocyanate "Coronate L" (Trademark) made by Nippon Polyurethane Industry Co., Ltd. | 3 |
| Carboxyl-modified silicone oil "SF8418" (Trademark) made by Toray Silicone Co., Ltd. | 1.5 |
| Epoxy-modified silicone oil "SF8411" (Trademark) made by Toray Silicone Co., Ltd. | 1.5 |
| Tetrahydrofuran | 90 |

The above-prepared coating liquid was coated on the dye-transfer layer of the recording medium A obtained in Example I by a wire bar, so that a top layer with a thickness of 1.5 μm was formed on the dye-transfer layer.

Thus, a sublimation-type thermal image transfer recording medium according to the present invention was obtained.

EXAMPLE II-2

The procedure for preparation of the sublimation-type thermal image transfer recording medium in Example II-1 was repeated except that the amount of the sublimable dye "Kayaset Blue 714" (Trademark) made by Nippon Kayaku Co., Ltd., in the formulation for the top layer coating liquid used in Example II-1 was changed from 15 parts by weight to 3.5 parts by weight.

Thus, a sublimation-type thermal image transfer recording medium according to the present invention was obtained.

EXAMPLE II-3

The procedure for preparation of the sublimation-type thermal image transfer recording medium in Example II-1 was repeated except that the amount of the sublimable dye "Kayaset Blue 714" (Trademark) made by Nippon Kayaku Co., Ltd., in the formulation for the top layer coating liquid used in Example II-1 was changed from 15 parts by weight to 5 parts by weight.

Thus, a sublimation-type thermal image transfer recording medium according to the present invention was obtained.

EXAMPLE II-4

The procedure for preparation of the sublimation-type thermal image transfer recording medium in Example II-1 was repeated except that the amount of the sublimable dye "Kayaset Blue 714" (Trademark) made by Nippon Kayaku Co., Ltd., in the formulation for the top layer coating liquid used in Example II-1 was changed from 15 parts by weight to 10 parts by weight.

Thus, a sublimation-type thermal image transfer recording medium according to the present invention was obtained.

REFERENCE EXAMPLE

The procedure for preparation of the sublimation-type thermal image transfer recording medium in Example II-1 was repeated except that the amount of the sublimable dye "Kayaset Blue 714" (Trademark) made by Nippon Kayaku Co., Ltd., in the formulation for the top layer coating liquid used in Example II-1 was not used.

Thus, a sublimation-type thermal image transfer recording medium for reference was obtained.

Each of the sublimation-type thermal image transfer recording media according to the present invention obtained in Examples I-1 to I-6 and II-1 to II-4, comparative sublimation-type thermal image transfer recording media obtained in Comparative Examples I-1 to I-4, and a sublimation-type thermal image transfer recording medium in Reference Example was subjected to a thermal recording test under the conditions that the resolution of a thermal head was 12 dots/mm, the applied energy was 0.64 mj/dot and the applied electric power was 0.16 W/dot, using an image receiving sheet prepared by the following method:

Preparation of Image Receiving Sheet

A mixture of the following components were thoroughly dispersed to prepare a coating liquid for a dye-receiving layer of the image receiving sheet:

| | Parts by Weight |
|---|---|
| Vinyl chloride-vinyl acetate-vinyl alcohol copolymer "VAGH" (Trademark) made by Union Carbide Japan K.K. | 10 |
| Isocyanate "Coronate L" (Trademark) made by Nippon Polyurethane Industry Co., Ltd.1 | 5 |
| Amino-modified silicone resin "SF-8417" (Trademark) made by Toray Silicone Co., Ltd. | 0.5 |
| Epoxy-modified silicone resin "SF-8411" (Trademark) made by Toray Silicone Co., Ltd. | 0.5 |
| Toluene | 40 |
| Methyl ethyl ketone | 40 |

The above-prepared dye-receiving layer coating liquid was coated on a sheet of commercially available synthetic paper with a thickness of approximately 150 μm, "Yupo FPG-150" (Trademark) made by Oji-Yuka Synthetic Paper Co., Ltd., by a wire bar and dried at 75° C. for 1 minute to form a dye-receiving layer with a thickness of about 5 μm, and then cured at 80° C. for 3 hours, whereby an image receiving sheet was prepared.

In this thermal recording test, a sublimation-type thermal image transfer recording medium capable of yielding magenta images was first prepared by repeating the procedure for preparation of the comparative sublimation-type thermal image transfer recording medium in Comparative Example I -1 except that the sublimable dye "Kayaset Blue 714" (Trademark) made by Nippon Kayaku Co., Ltd., was replaced by a sublimable dye "MS-Magenta VP" (Trademark) made by Mitsui Toatsu Dyes, Inc.

Test by the n-times-speed mode method

Step-1

The above-prepared sublimation-type thermal image transfer recording medium capable of yielding a magenta color was overlaid on the image-receiving sheet, and the thermal recording was carried out by the n-times-speed mode method under the conditions that a transporting speed of the image-receiving sheet was 8.5 mm/sec and that of the thermal image transfer recording medium was 0.6 mm/sec. Thus, block pattern images of a magenta color (M) as shown in FIG. 1 were thermally printed on the image-receiving sheet.

The density of the magenta color block image formed on the image-receiving sheet, which was measured by a Mcbeth densitometer, exceeded 2.0.

Step-2

Figure 2:
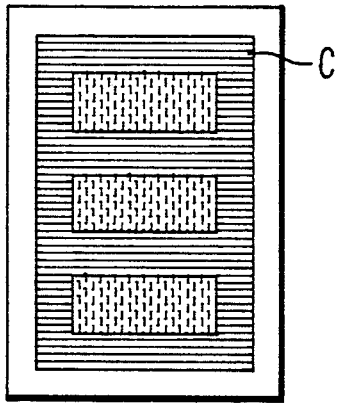
FIG. 2 illustrate an image-receiving sheet carrying block images of a magenta color, on which a solid image of a cyan color is superimposed.

Successively, using the sublimation-type thermal image transfer recording medium, for example, obtained in Example I-1, a solid image of a cyan color (C) was superimposed on the above-prepared magenta color block-pattern images by the n-times-speed mode method, as shown in FIG. 2, under the same energy applied to the thermal image transfer recording medium. In this time, the transporting speed of the image-receiving sheet was 8.5 mm/sec and that of the thermal image transfer recording medium was 0.4 mm/sec.

Figure 3:
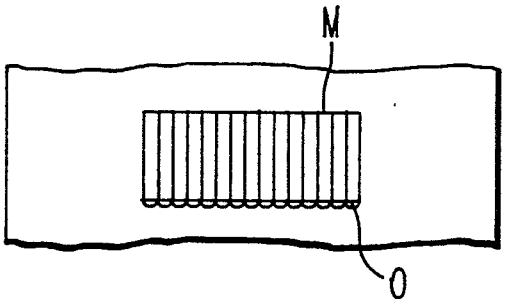
FIG. 3 is a schematic enlarged view of trailing edge portions of the block image of a magenta color.

As a result, the magenta dye first transferred to the image-receiving sheet was reversely transferred to the thermal image transfer recording medium of a cyan color, and the magenta dye thus reversely transferred to the recording medium was transferred again to the image-receiving sheet. Thus, edge portions of the magenta-color block images were observed to draw a trail, represented by "0" in FIG. 3.

Figure 4:
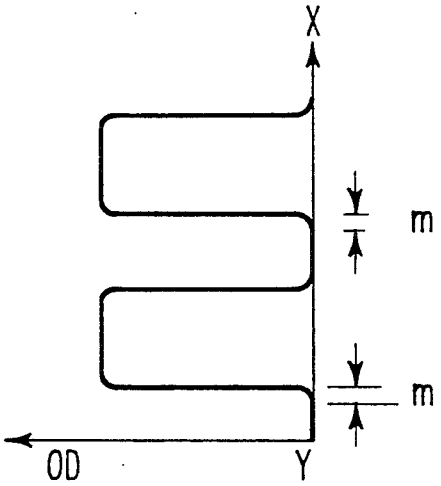
FIG. 4 is a schematic enlarged view of an image-receiving sheet which carries block images of a magenta color, subjected to the measurement of the optical density of the magenta color thereof.
Figure 5:
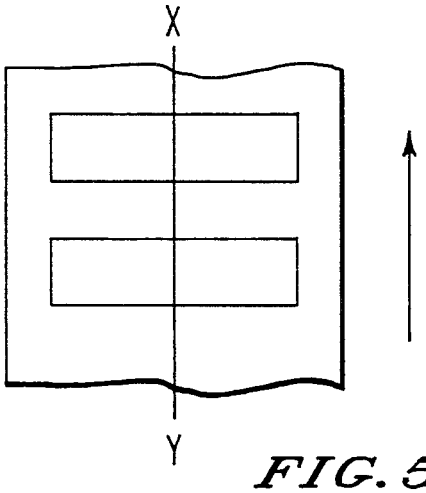
FIG. 5 is a plot of the optical density of the image-receiving sheet shown in FIG. 4.

When the magenta-color block images were formed on the image-receiving sheet in the above Step-1, as shown in FIG. 4, the optical density (OD) of the magenta color on the image-receiving sheet was plotted in the transporting direction of the sheet (Y to X), as shown in FIG. 5.

Figure 6:
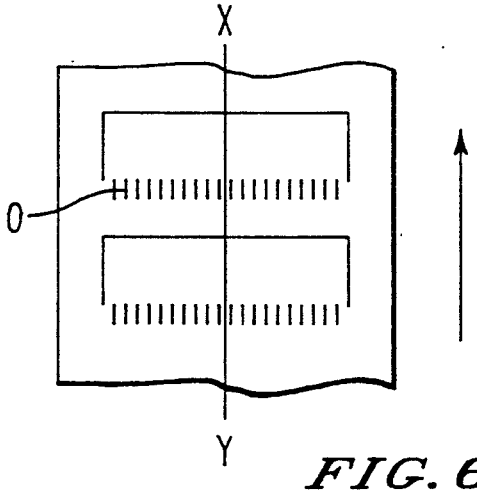
FIG. 6 is a schematic enlarged view of an image-receiving sheet which carries block images of a magenta color, on which a solid image of a cyan color is superimposed, subjected to the measurement of the optical density of the magenta color thereof.
Figure 7:
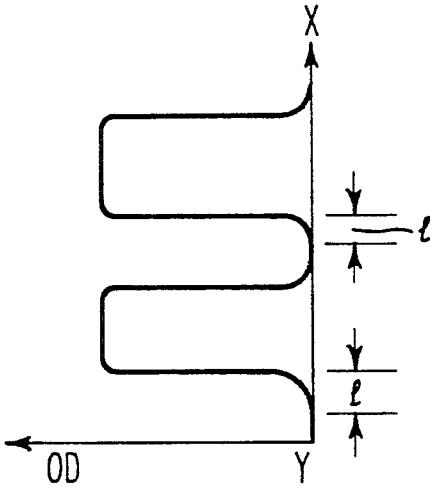
FIG. 7 is a plot of the optical density of the image-receiving sheet shown in FIG. 6.

When the solid cyan image was superimposed on the magenta block images first formed on the image-receiving sheet in the above Step-2, as shown in FIG. 6, the optical density (OD) of the magenta color on the image-receiving sheet was plotted in the transporting direction of the sheet (Y to X), as shown in FIG. 7.

In FIGS. 5 and 7, the optical density of the magenta color block images on the image-receiving sheet was measured by a commercially available microphotometer "MPM-2" (Trademark), made by Union Optical Co., Ltd., with Wratten filter #58, and the change in the optical density of the image-receiving sheet was microscopically plotted in the direction from Y to X.

From these two plots shown in FIGS. 5 and 7, the length of a trailing edge was obtained by subtracting the value "m" shown in FIG. 5 from the value "l" in FIG. 7. The length of a trailing edge, that is, the maximum value obtained in accordance with the above calculation, is shown in Tables 1 and 2. The results given in Tables 1 and 2 illustrate that the shorter the length of a trailing edge, the fewer the reverse transfer.

Test by the equal-speed mode method

On the above obtained magenta color block-pattern images, a solid image of a cyan color was superimposed using the sublimation-type thermal image transfer recording medium, for example, obtained in Example I-1, by the equal-speed mode method under the conditions that both the image-receiving sheet and the thermal image transfer recording medium were transported at a speed of 8.5 mm/sec. In this time, the density ($D_1$) of a magenta color in the solid cyan image was measured by a Mcbeth densitometer RD-918.

With the same zone of the thermal image transfer recording medium of a cyan color as used in superimposing the above-mentioned solid cyan image on the magenta block-pattern images and another image-receiving sheet carrying no image thereon being overlapped, a solid cyan image was thermally printed on the image-receiving sheet under the same conditions as in the above. In this time, the density ($D_2$) of a magenta color of the potential magenta block-pattern images in the solid cyan image was measured by the same densitometer as in the above.

The density of a ghost image of a magenta color was obtained by subtracting the density $D_2$ from the density $D_1$.

The results are given in Tables 1 and 2.

Figure 8:
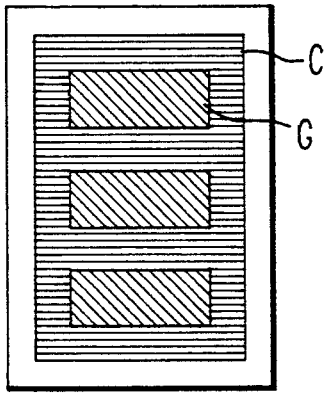
FIGS. 8 and 9 illustrate the presence or absence of a ghost image after color images are overlapped.
Figure 9:
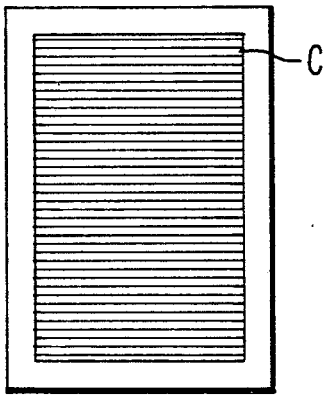

On the image-receiving sheet shown in FIG. 8, ghost images (G) of a magenta color appear in the solid cyan image (C). In FIG. 9, there is no ghost image in the solid cyan image (C) on the image-receiving sheet.

TABLE 1

| | Image Density (A)* | Length of Trailing Edge (l - m) (μm) | Density of Ghost Image |
|---|---|---|---|
| Ex. I-1 | 0.93 | 827 | 0.05 |
| Ex. I-2 | 0.93 | 719 | 0.05 |
| Ex. I-3 | 1.12 | 829 | 0.08 |
| Ex. I-4 | 1.06 | 1079 | 0.07 |
| Ex. I-5 | 0.90 | 935 | 0.06 |
| Ex. I-6 | 0.15 | 755 | 0.04 |
| Comp. Ex. I-1 | — | 2014 | 0.22 |
| Comp. Ex. I-2 | 1.30 | 1582 | 0.20 |
| Comp. Ex. I-3 | 1.43 | 1654 | 0.21 |
| Comp. Ex. I-4 | 1.50 | 1438 | 0.22 |

The image density (A)* was measured in the following manner:

The same formulation for the top layer coating liquid as used in preparing each sublimation-type thermal image transfer recording medium was coated on a sheet of commercially available synthetic paper "Yupo FPG#95" (Trademark), made by Oji-Yuka Synthetic Paper Co., Ltd., and dried at 70° C. for one minute and at room temperature for one day or more. Thus, a resin layer with a thickness of 10 μm on a dry basis was formed on a base sheet.

A commercially available thermal image transfer ink ribbon of a cyan color, "Sheet Set CK2LB" for Mitsubishi color video copy processor, was overlaid on the above-prepared resin layer. Then, thermal image transfer was conducted with the application of the thermal energy of 2.00 mj/dot to the thermal image transfer ink ribbon by using a commercially available thermal head "KMT-85-6MPD4" (Trademark), made by Kyocera Corp., with a resolution of 6 dots/mm and an average resistivity of 542 Ω. The density of images thus transferred to the resin layer was measured by a Mcbeth reflection-type densitometer RD-918.

TABLE 2

| | Image Density (B)** | Length of Trailing Edge (l - m) (μm) | Density of Ghost Image |
|---|---|---|---|
| Ex. II-1 | 2.37 | 1200 | 0.07 |
| Ex. II-2 | 2.08 | 950 | 0.05 |
| Ex. II-3 | 2.53 | 980 | 0.05 |
| Ex. II-4 | 2.38 | 1000 | 0.05 |
| Reference Example | 1.82 | 950 | 0.05 |

The image density (B)* was a density of a cyan color image without a ghost image.

Furthermore, when the surface of the dye-transfer layer of each recording medium was observed with a scanning-type electron microscope at a 12,000× magnification, numerous crystals of the sublimable dye with a diameter of several micrometers were observed in the form of needles only in Example II-1.

As previously explained, the sublimation-type thermal image transfer recording media according to the present invention have the following advantages:

(1) The reverse transfer from the image-receiving sheet can be remarkably reduced when one color is superimposed on the other color since the top layer comprising a non-dyeable resin or low-dyeable resin is formed on the dye-transfer layer. As a result, the problem of drawing a tail at the edge portion of the image in the n-times-speed mode, and the problem of causing a ghost image in the equal-speed mode can be effectively solved.

(2) The dye-supply layer comprises at least the sublimable dye in the form of granules and the dye-transfer layer comprises at least the sublimable dye in the form of molecules. Therefore, the dye concentration in the dye-supply layer can be maintained and the multi-utilization capability of the recording medium is improved.

In addition, the sublimable dye contained in the dye-transfer layer is soluble in an organic solvent, so that the dye concentration in the dye-transfer layer can be increased, thereby avoiding the decrease in sensitivity.

(3) The top layer comprises a lubricant, so that the transport performance of the recording medium is excellent and the sticking problem does not occur when the thermal image transfer recording is carried out by the n-times-speed mode method.

(4) The top layer comprises a sublimable dye, which improves the effect of preventing the occurrence of a ghost image and a trailing edge, and at the same time, prevents the decrease in sensitivity.

(5) The sublimable dye is contained in the form of individually separated molecules in the top layer, so that the unevenness in the image density can be prevented and a solid image becomes uniform.

What is claimed is:

1. A sublimation-type thermal image transfer recording medium comprising a support, a dye-supply layer and a dye-transfer layer which are successively overlaid on said support, each layer comprising a sublimable dye and an organic binder agent in which said sublimable dye is dispersed, and a top layer provided on said dye-transfer layer, comprising a non-dyeable resin or a low-dyeable resin wherein part of said sublimable dye in said dye-supply layer is in the state of undissolved particles, and said sublimable dye in said dye-transfer layer is in the stage of individually dispersed molecules.

2. The sublimation-type thermal image transfer recording medium as claimed in claim 1, wherein said top layer has a thickness of 0.1 to 2 μm.

3. The sublimation-type image transfer recording medium as claimed in claim 1, wherein said non-dyeable resin or low-dyeable resin in said top layer is organic-solvent soluble.

4. The sublimation-type image transfer recording medium as claimed in claim 1, wherein said top layer further comprises a lubricant.

5. The sublimation-type image transfer recording medium as claimed in claim 1, wherein said non-dyeable resin or low-dyeable resin is selected from the group consisting of silicone resin, styrene-maleic acid copolymer resin, maleic acid ester resin, styrene-acrylonitrile copolymer resin, polysulfone resin, and polymethacrylate resin.

6. The sublimation-type image transfer recording medium as claimed in claim 1, wherein said non-dyeable resin or low-dyeable resin in said top layer further comprises a sublimable dye.

7. The sublimation-type image transfer recording medium as claimed in claim 6, wherein said sublimable dye in said top layer is present in a dissolved state in said non-dyeable resin or low-dyeable resin.

8. The sublimation-type image transfer recording medium as claimed in claim 6, wherein said sublimable dye in said top layer is contained in a concentration of 20 wt.% to 50 wt.% of the weight of said non-dyeable resin or low-dyeable resin.

* * * * *

UNITED STATES PATENT AND TRADEMARK OFFICE

CERTIFICATE OF CORRECTION

PATENT NO. : 5,143,893

DATED : September 1, 1993

INVENTOR(S) : Hidehiro MOCHIZUKI, et al.

It is certified that error appears in the above-identified patent and that said Letters Patent is hereby corrected as shown below:

Column 1, line 51, change "ca" to --can--.

Column 2, line 3, after "can" insert --be--.

Column 4, line 13, change "layer In" to --layer. In--.

Column 5, line 40, change "o" to --on--.

Column 9, line 58, change "the to layer" to --the top layer--.

Column 18, line 38, change "above calculation" to --above-calculation--.

Signed and Sealed this

Twenty-eighth Day of December, 1993

*Attest:*

Bruce Lehman

BRUCE LEHMAN

*Attesting Officer*

*Commissioner of Patents and Trademarks*